United States Patent [19]

Kathke

[11] Patent Number: 4,804,151

[45] Date of Patent: Feb. 14, 1989

[54] METHOD AND MEANS FOR CONTROLLING THE AUTOMATIC WINDING OF YARN ON A TAKE-UP PACKAGE OF A TEXTILE WINDING MACHINE

[75] Inventor: Gregor Kathke, Viersen, Fed. Rep. of Germany

[73] Assignee: W. Schlafhorst & Co., Fed. Rep. of Germany

[21] Appl. No.: 137,398

[22] Filed: Dec. 23, 1987

[30] Foreign Application Priority Data

Dec. 24, 1986 [DE] Fed. Rep. of Germany ..... 3644433

[51] Int. Cl.[4] ..... B65H 54/22

[52] U.S. Cl. ..... 242/35.6 R; 242/36; 242/37 R; 242/39

[58] Field of Search ..... 242/35.6 R, 36, 37 R, 242/39, 35.5 R, 18 R; 73/160

[56] References Cited

U.S. PATENT DOCUMENTS 3,918,651 11/1975 Uchida ..... 242/36
4,195,790 4/1980 Reiners et al. ..... 242/37 R
4,351,494 9/1982 Schippers et al. ..... 242/35.5 A
4,512,526 4/1985 Tone et al. ..... 242/36
4,555,068 11/1985 Kamp ..... 242/36
4,666,096 5/1987 Heel et al. ..... 242/36
4,703,900 11/1987 Noshi et al. ..... 242/35.5 R

*Primary Examiner*—Stanley N. Gilreath
*Attorney, Agent, or Firm*—Shefte, Pinckney & Sawyer

[57] ABSTRACT

Automatic winding of yarn on a take-up package of a textile winding machine is controlled with devices including a yarn severing device actuated when the winding is interrupted, a device for sensing the quality of winding of the package, and a processing device that is responsive to a batch change signal which corresponds to an indication of dissimilarity of characteristics between the take-up yarn and the supply yarn. Re-starting of the winding is prevented if the package does not have preset quality characteristics and/or if there is a dissimilarity between the take-up yarn and the supply yarn. Another condition for re-start is the detection by a yarn presence monitoring device that a joined yarn is present, indicating the correction of the yarn interruption after actuation of a yarn joining device.

9 Claims, 1 Drawing Sheet

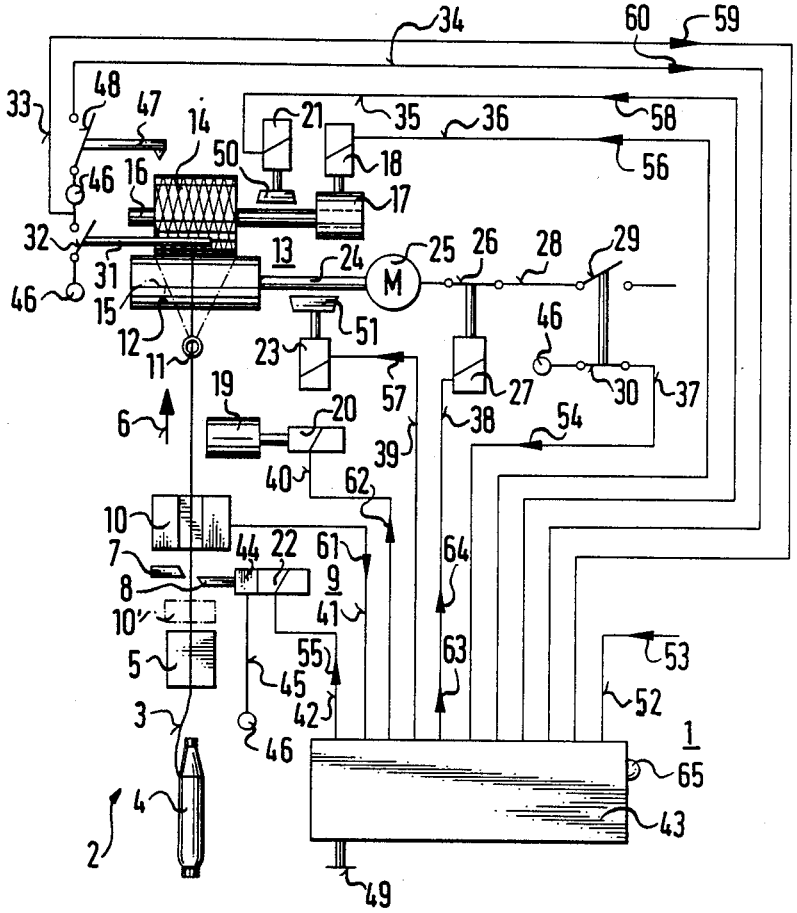
34
60
59
33
48
47
14
21
35
36
58
50
18
56
46
16
17
32
13
24
25
26
28
29
31
M
46
15
51
46
12
11
23
57
27
30
37
19
20
38
54
6
39
40
62
10
44
22
61
64
7
9
8
41
10'
55
63
53
5
45
52
3
42
46
1
65
4
43
2
49

METHOD AND MEANS FOR CONTROLLING THE AUTOMATIC WINDING OF YARN ON A TAKE-UP PACKAGE OF A TEXTILE WINDING MACHINE

BACKGROUND OF THE INVENTION

The present invention relates to a method and means for controlling the automatic winding of yarn of a take-up package of a textile winding machine, such as a machine that forms cross-wound packages of yarn, and is of the type including a yarn severing device, a yarn presence monitoring device, a yarn joining device, a yarn take-up package driving device and a yarn accumulation sensing device. In this type of winder the winding is interrupted when a predetermined accumulation of yarn is reached on the package, at which time the yarn is severed and subsequently a supply yarn can be joined to a take-up yarn for a subsequent winding operation.

Conventionally, packages are wound on such winders until a predetermined yarn accumulation is obtained in terms of a predetermined package size or yarn length. However, conventional winders do not monitor other quality characteristics of the package and yarn and do no operate to maintain predetermined quality characteristics.

SUMMARY OF THE INVENTION

In contrast, the present invention provides a method and means for controlling the automatic winding of yarn on a take-up package of a textile winding machine of the type described, in a manner that obtains uniformly high quality of the yarn and package throughout. Basically, this advantage is obtained by actuating the yarn severing device at each interruption of winding independent of the cause of interruption, sensing the quality of winding at each interruption, comparing the characteristics of the supply yarn and the take-up yarn at each interruption, and preventing automatic winding restart if at least one of (a) the sensing of winding quality senses less than a predetermined quality or (b) the characteristics of the yarn being compared are dissimilar.

As a result, the method and means of the present invention prevent winding to continue onto the package after winding has been interrupted. Thus, no quality defects can occur that normally result from continued winding after an interruption. Moreover, desired quality of the yarn package is assured by sensing the quality of the winding and preventing restart of winding until the cause of low quality can be determined and eliminated before restarting of the winding. In this regard, any package that does not meet the quality standard is separated out, and this occurs at any time that there is a winding interruption during production of the package.

Further, winding is preferably continued only if the characteristics of the supply yarn and take-up yarn are similar. If the winding interruption occurs at a time at which the yarn had not yet entirely run off the supply bobbin, yarn similarity normally results. However, if the winding was interrupted due to the supply bobbin becoming empty without a substitute being presented or due to a batch change, no similarity of characteristics will be sensed and winding will not be restarted.

Accordingly, automatic winding control with assurance of quality is obtained by the present invention by winding not being restarted in the case of a non-correctable interruption or sensing of a quality defect caused by the interruption. Thus, restarting is prevented only in those instances resulting in disadvantageous quality, in which case a search can be made for the causes even at early stages of yarn build-up on the package.

Preferably, the present invention provides for removing the package from the package driving device and braking the removed package synchronously with the yarn severing. This provides two important advantages, one is the rapid stopping of the package and the other is avoiding pressing and friction of the package on the friction roller of the package driving device during stopping.

A further feature of the preferred embodiment of the present invention is preventing restarting of the winding until the yarn monitoring device has determined the renewed presence of a yarn, indicating the successful joining of the supply yarn and take-up yarn by the yarn joining device. This presents a premature restart of winding, which would otherwise occur and result in another winding interruption. Instead, the yarn joining operation can be repeated and, if unsuccessful, the cause can be investigated at an early stage without unnecessary restarting and interruption.

The means for controlling the automatic winding of yarn according to the present invention includes a yarn severing device, a yarn presence monitoring device, a yarn joining device, and a yarn accumulation sensing device. The means functions to perform the method of the present invention utilizing a processing device operatively connected to the yarn severing device, to the yarn present monitoring device, to the yarn joining device and to the yarn accumulation sensing device. The means also includes a device for stopping operation of the package driving device operatively connected to the processing device, and a device for sensing the quality of winding of the package is provided and is operatively connected to the processing device. The processing device is capable of receiving winding interruption signals and batch change signals and is operable in response to the yarn accumulation sensing device, to the quality sensing device, to the winding interruption signals and to the batch change signals for actuation of the stopping device and yarn severing device in response to a winding interruption signal, and for actuation of the yarn joining device in response to a winding interruption signal when the quality of winding sensed by the quality sensing device is above a predetermined quality and no batch change signal is present.

Preferably, the controlling means includes a device for removing the package from the package driving device operatively connected to the processing device, and a device for braking removed packages operatively connected to the processing device, with the processing device actuating the package removing device and the package braking device in response to a winding interruption signal.

The yarn severing device can be, for example, pneumatically or electrically switchable or releasable knives, the yarn monitoring devices can be, for example, yarn feelers, yarn cleaners or the like, the yarn joining devices can be, for example, automatic knotting devices or automatic, particularly pneumatically active, yarn splicing devices. The package driving devices can be, for example, a motor-driven winding roller on which the package rests and by means of which the package is driven by friction. The package driving device can also function to traverse the yarn along the width of the package by reversing grooves on the drive roller, or the yarn can be traversed by a special traversing device of a conventional form. The yarn accumulation sensing device can be responsive to, for example, the diameter or the fullness of the yarn package or to the yarn length. The processing device can be located at a central position in the textile machine for controlling a plurality of winding stations, or individual processing devices can be located at each winding station, whichever is more advantageous for a particular use.

If an electric drive motor is used for the package driving device, the device for stopping operation of the package driving device may be an electrical switch. Otherwise, it could be, for example, a movable friction roller.

It is advantageous for the winding quality sensing device to be a sensor for checking the hairiness of the yarn on the package, for checking the contour of the package or for checking the hardenss of the package.

The batch change signal can be received from a hand-operated switch or by a feeler that provides a signal to the processing device.

The processing device may be, for example, mechanical, electromechanical, pneumatic, or, preferably, electronic calculating and/or data processing equipment of conventional design.

The package braking device can be, for example, an electromagnetic drive, as can be the package removing device.

The operative connections of the various devices to the processing device can be, for example, electric, hydraulic, pneumatic or light connections. Mechanical switching and actuating rods could also be used.

To assure yarn severing regardless of the main power supply, an independent energy source may be provided for operating the yarn severing device. This is particularly advantageous to obtain a yarn severing when the power to the machine is turned off or there is a failure in the power supply. Trouble-free energy sources that may be used are a capacitor, a compressed air tank, a battery, an auxiliary electrical circuit, and, in the simplest instance, a loaded spring storage device or a spring under tension.

Preferably, the device for stopping operation of the package driving device is de-actuated by the processing device in response to the monitoring device sensing the presence of a yarn following actuation of the yarn joining device. In this manner, the stopping device cannot be de-actuated to restart winding until a successful yarn joining operation has taken place.

In an alternate embodiment of the present invention, the yarn presence monitoring device is disposed in advance of the yarn severing device in relation to the direction of the yarn travel, and the processing device is responsive to the monitoring device to prevent actuation of the yarn joining device until the monitoring device senses the presence of the supply yarn thereat.

Other and further features and advantages of the present invention will be apparent from the accompanying drawings and the following detailed description.

BRIEF DESCRIPTION OF THE DRAWING

The accompanying drawing is a schematic illustration of a textile winding machine incorporating the preferred embodiment of the means for controlling the automatic winding of yarn on a take-up package of a textile winding machine of the preferred embodiment of the present invention and in which the method of controlling the automatic winding of yarn on a take-up package of a textile winding machine of the preferred embodiment of the present invention is carried out.

DETAILED DESCRIPTION OF THE PREFERRED EMBODIMENTS

The schematic drawing illustrates a textile machine 1 in the form of an automatic winder with a winding station 2 at which yarn 3 is wound from a delivery bobbin 4, which in the illustrated embodiment is in the form of a spinning cop previously produced on a spinning machine. The yarn 3 travels through a balloon breaker 5 in the direction of the arrow 6 upwardly between the cutting edges 7,8 of a yarn severing device 9, through a yarn presence monitoring device 10 and a guide eyelet 11. The yarn 3 continues past the winding drum 12 of a package driving device, designated in its entirety by the reference numeral 13, to the cross-wound package 14. The traversing of the yarn 3 within the traversing triangle indicated by the reference numeral 15 is performed by a conventional reciprocating guide (not shown).

The package 14 is mounted on a shaft 16 that projects from a bearing 17 that can be moved vertically to remove the package 14 from the winding drum 12 by means of the package removing device 18.

A yarn joining device 19 is mounted adjacent the yarn 3 and can be moved into operable position by an electromagnetic drive 20.

The winding drum 12 is mounted on a shaft 24 that is driven by a motor 25 that is connected to a frequency-controlled operating power source through an electrical contact 26, an electrical lead line 28, and a main switch 29 that is coupled to an auxiliary switch 30.

A winding quality sensing device 32 includes a hairiness sensor 31 mounted in front of the package 14 for checking the winding quality. The device 32 is operatively connected through an electrical lead line 33 to an information processing device 43.

The yarn severing device 9 includes a solenoid 44 having a cutting edge 8 projecting therefrom and connected by an electrical lead line 45 to an independent source of electrical power 46. Although the solenoid 44 is constantly under power and thus urged to shift edge 8 to the left past stationary edge 7 to sever the yarn 3, the operating force is overcome by the force of an electromagnetic drive 22 that is operable during the winding operation through a connection 42 to the processing device 43.

The yarn presence monitoring device 10 has an operative connection 41 to the processing device 43. Similarly, the yarn joining device 19 is operated by an electromagnetic drive 20 through an operative connection 40 to the processing device 43. A yarn accumulation sensing device 48 has a sensor 47 disposed above the package 14 and is connected by an operative connection 34 to the processing device 43. Similarly, a device 27 for stopping operation of the package driving device 13 is connected to the aforementioned switch 26 and is operatively connected through a connection 38 to the processing device 43.

The processing device 43 includes a batch change signaling device 49 in the form of a hand-operated switch.

The winding station 2 also includes a package braking device 50 actuated by an electromagnetic drive 21 that is operatively connected by connection 35 to the processing device 43. This braking device 50 operates in conjunction with the package removing device 18, which is also operatively connected through connection 36 to the processing device 43.

The package driving device 13 is provided with a braking device 51, which is actuated by an electromagnetic drive 23 that has an operative connection 39 to the processing device 43. Similarly, the aforementioned auxiliary power switch 30 has an operative connection 37 to the processing device 43. A stop signal 53 can also be applied to the processing device 43 through electrical lead line 52.

The illustration shows the components of the controlling device during a normal winding operation. In the illustration, main power has been disconnected by opening of the switch 29, so that the motor 25 no longer receives power. This opening of the switch 29 results in a closing of the auxiliary switch 30 so that a signal 54 indicating a stoppage of the package driving device 13 is passed to the processing device 43, with the signal 54 being powered from the independent voltage source 46. When this occurs, a signal 55 is emitted from the processing device 43 through operative connection 42 to the electromagnetic drive 22 of the yarn severing device 9. The electromagnetic drive 22 is de-actuated by this signal so that the force of the solenoid 44 supplied from the independent power source 46 causes the solenoid 44 to operate to project the cutting edge 8 across the stationary edge 7, thereby severing the yarn 3.

In a time interval of at least a few milliseconds to one second, a signal 56 is emitted through the operative connection 36 from the processing device 43 to the package removing device 18, a braking signal 57 is emitted to the electromagnetic drive 23 of the braking device 51 through the connection 39, and a braking signal 58 is emitted to the electromagnetic drive 21 of the braking device 50. The result of this is that only a small length of yarn is wound on the package following severing and the package 14 is raised from the winding drum 12 and the winding drum shaft 24 and package supporting shaft 16 are simultaneously braked. Following braking, the signals 57,58 are discontinued.

In the embodiment illustrated the characteristics of the supply yarn and the take-up yarn are compared by the processing device 43 simply by determining whether the batch change device 49 has been actuated. As no batch change is indicated in the illustration, the batch change signaling device 49 remains unactuated and the processing device 43 thereby assumes that the yarn characteristics of the supply yarn and the take-up yarn are similar.

In the meantime, the device 32 for sensing the quality of the winding of the package and the yarn accumulation sensing device 48 are in active condition. The hairiness sensor 31 of the quality sensing device 32 has determined that no unusual hairiness of the yarn exists on the package 14 so that no signal is emitted. If poor quality is sensed, a signal 59 would be emitted to the processing device 43 from the independent power source 46 through the operative connection 33 with the quality sensing device 32 connected and with the consequence that the winding would be stopped. The sensor 47 of the yarn accumulation sensing device 48 has not yet determined that a sufficiently large accumulation of yarn is present on the package 14. Therefore, the yarn accumulation sensing device 48 is not active. If a full accumulation of yarn were present on the package 14, a signal 60 would be emitted to the processing device 43 from the independent power source 46 through the yarn accumulation sensing device 48 and by the operative connection 34 to the processing device 43.

As long as the yarn 3 is running through the yarn presence monitoring device 10, a yarn presence signal 61 is emitted through the operative connection 41 to the processing device 43. The non-presence of a yarn 3 would cause the yarn presence monitoring device 10 to emit a signal 61 to the processing device 43 which would initiate the stopping of the winding and the actions described above.

A yarn joining signal 62 passes in a timed relationship with the yarn severing signal 55 after a predetermined time during which the bobbin driving device 13 and bobbin 14 have come to a stop. The signal 62 passes through the operative connection 40 to the electromagnetic drive 20 of the yarn joining device 19 if there are no signals to prevent this in accordance with the present invention. Since in the illustration there are no such preventing signals, the yarn joining device 19 is actuated in the conventional manner to pick up the take-up yarn end by a gripper from the surface of the package 14 and pick-up the supply yarn end by a gripper from the balloon breaker 5 and place the yarn ends in the yarn joining device 19 for joining by knotting or splicing.

In the illustrated embodiment, the package drive motor 25 is de-energized by the open condition of the main switch 29. Because of this, the contactor 27 does not have to open the contact 26 as a stop signal 54 is given through the connection 37 to the processing device 43 by the closed auxiliary switch 30 and independent power source 46. However, since the winding interruption signal can also come from an exterior signal 53 through the electrical lead line 52 a drive interruption signal 63 can pass simultaneously with a package removing signal 56 and braking signals 57,58 to the contractor 27, so that the contact 26 also can be opened.

After the yarn joining has been completed, the winding can be re-started by discontinuing the package removal signal 56 so that the package 14 returns to driven engagement on the winding drum 12. The contactor 27 must also be closed, but it does not receive a signal 64 through the operative connection 38 from the processing device 43 until the winding interruption signal 54 has been discontinued, i.e. when the main switch 29 has been closed. The package drive motor 25 can be designed conventionally so that a gentle start occurs, thereby protecting the yarn winding on the package 14.

The yarn joining device 19 only receives a yarn joining signal 62 if any winding interruption signal, in this instance the interruption signal 54, is present and if, in addition, a batch change has not been signaled by the batch change signaling device 49 and no poor-quality signal 59 is received from the quality sensing device 32.

The contactor 27 of the motor 25 of the package drive device 13 is maintained deactivated in addition by the yarn presence monitoring device 10 in that no operating signal 64 is emitted to the contactor 27 until the yarn presence monitoring device 10 has detected the renewed presence of a yarn 3, indicating the correction of the yarn interruption after actuation of the yarn joining device 19, which yarn presence detection is emitted as a signal 61 to the processing device 43. This prevents a useless starting of winding.

A signal light 65 is lit from the time of the entry of an interruption signal to the processing device 43 to the time at which the contactor 27 is activated. This signal light 55 indicates the stopped winding of the machine and alerts an attendant to correct the problem if the light remains lit for an excessive time.

It should be understood that the present invention is not limited to the embodiment illustrated and described. For example, it may be advantageous to locate the yarn presence monitoring device 10 at the position indicated in dot-dash lines and designated by the reference numeral 10', which is in advance of the yarn severing device 9 in relation to the direction of yarn travel, and the processing device 43 is responsive to the monitoring device 10 to prevent actuation of the yarn joining device 19 until the monitoring device 10' senses the presence of the supply yarn thereat. In this arrangement the supply yarn remains in the yarn monitoring device 10' and its absence indicates that the supply bobbin 4 is empty. This information can be used to signal an automatic replacement of the supply bobbin before restarting of winding.

In another variation, the yarn joining device can be activated on a timed delay in relation to a change of the package 14 upon the yarn accumulation sensing device 48 emitting a winding interruption signal 60. The signal from the yarn presence monitoring device 10 would then be delayed until shortly before the package change, so that erros due to the yarn being in the monitoring device too long are avoided.

Alternatively, the stoppage of the package and also the stoppage of the drive device can be measured and then the yarn joining signal 62 can be emitted in response thereto.

In another embodiment, the devices of the invention can be a sequence of a yarn tensioning device, a yarn joining device, a yarn presence monitoring device, a controlled yarn clamp, a yarn severing device, a yarn paraffin applying device and a pneumatic yarn engaging jet.

In order to retrieve the take-up yarn from the package 14, the package driving device 13 can be put in reverse for a period of time and the package placed on the winding drum 12, following which a subsequent removal of the package from the winding drum could be omitted upon subsequent braking after the yarn pick-up has taken place.

A comparison of the characteristics of the supply yarn and the take-up yarn can alternatively be determined by the yarn presence monitoring device 10, provided the yarn presence monitoring device 10 has the capability of comparing the yarns with normal values.

The yarn accumulation sensing device 48 can alternatively consist of a yarn length meter so that when a preset length of yarn has been wound, the yarn accumulation signal 60 is emitted.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A method of controlling the automatic winding of yarn on a take-up package of a textile winding machine of the type having a yarn severing device, a yarn presence monitoring device, a yarn joining device, a yarn take-up package driving device, and a yarn accumulation sensing device, said method comprising actuating said yarn severing device to sever the yarn being wound at each interruption of winding independent of the cause of interruption, sensing the quality of winding at each interruption, comparing the characteristics of the supply yarn and the take-up yarn at each interruption, and preventing automatic winding restart if at least one of said quality sensing senses a winding quality less than a predetermined quality or the characteristics of the yarn being compared are dissimilar.

2. A method of controlling the automatic winding of yarn on a take-up package of a textile winding machine according to claim 1 and characterized further in that said winding quality sensing senses at least one of the quality of the wound package or the quality of the yarn wound on the package.

3. A method of controlling the automatic winding of the yarn on a take-up package of a textile winding machine according to claim 1 and characterized further by removing said package from said package driving device and by braking said removed package synchronously with said yarn severing.

4. A method of controlling the automatic winding of the yarn on a take-up package of a textile winding machine according to claim 1, 2 or 3 and characterized further in that said preventing automatic winding restart includes preventing restart unless said yarn monitoring device detects the presence of a yarn after a successful yarn joining by said yarn joining device.

5. Means for controlling the automatic winding of a yarn on a take-up package of a textile winding machine of the type having a yarn severing device, a yarn presence monitoring device, a yarn joining device, a yarn take-up package driving device, and a yarn accumulation sensing device, said controlling means comprising a processing device operatively connected to said yarn severing device, to said yarn monitoring device, to said yarn joining device and to said yarn accumulation sensing device, a device for stopping operation of said package driving device operatively connected to said processing device, a device for sensing the quality of the winding of the package operatively connected to said processing device, said processing device being capable of receiving winding interruption signals and batch change signal, said processing device being operable in response to said yarn accumulation sensing device, to said quality sensing device, to said winding interruption signals and to said batch change signals for actuation of said stopping device and said yarn severing device in response to a winding interruption signal, and for actuation of said yarn joining device in response to a winding interruption signal when the quality of winding sensed by said quality sensing device is above a predetermined quality and no batch change signal is present.

6. Means for controlling the automatic winding of a yarn according to claim 5 and characterized further in that said monitoring device is disposed in advance of said yarn severing device in relation to the direction of yarn travel and said processing device is responsive to said monitoring device to prevent actuation of said yarn joining device until said monitoring device senses the presence of the supply yarn thereat.

7. Means for controlling the automatic winding of a yarn according to claim 5 and characterized further by a device for removing the package from said package driving device operatively connected to said processing device, a device for braking removed packages operatively connected to said processing device, said processing device actuating said package removing device and said package braking device in response to a winding interruption signal.

8. Means for controlling the automatic winding of a yarn according to claim 5 and characterized further by an independent energy source for operating said yarn severing device.

9. Means for controlling the automatic winding of a yarn according to claim 5, 6, 7 or 8 and characterized further in that said processing device deactuates said stopping device in response to said monitoring device sensing the presence of a yarn following actuation of said yarn joining device.

* * * * *